US006757651B2

(12) United States Patent
Vergin

(10) Patent No.: US 6,757,651 B2
(45) Date of Patent: Jun. 29, 2004

(54) SPEECH DETECTION SYSTEM AND METHOD

(75) Inventor: Julien Rivarol Vergin, Seattle, WA (US)

(73) Assignee: Intellisist, LLC, Bellevue, WA (US)

( * ) Notice: Subject to any disclaimer, the term of this patent is extended or adjusted under 35 U.S.C. 154(b) by 0 days.

(21) Appl. No.: 10/024,350

(22) Filed: Dec. 17, 2001

(65) Prior Publication Data

US 2003/0046070 A1 Mar. 6, 2003

Related U.S. Application Data

(60) Provisional application No. 60/315,805, filed on Aug. 28, 2001.

(51) Int. Cl.[7] ..... G10L 11/02
(52) U.S. Cl. ..... 704/233; 704/219
(58) Field of Search ..... 704/233, 256, 704/219; 340/995; 455/152.1

(56) References Cited

U.S. PATENT DOCUMENTS 4,052,568 A * 10/1977 Jankowski ..... 704/233
4,625,083 A * 11/1986 Poikela ..... 704/233
5,263,181 A * 11/1993 Reed ..... 455/152.1
5,857,169 A * 1/1999 Seide ..... 704/256
6,064,323 A * 5/2000 Ishii et al. ..... 340/995

OTHER PUBLICATIONS

Thomas W. Parsons, Voice and Speech Processing, 1987, McGraw–Hill, Inc., pp. 136–141.*

* cited by examiner

*Primary Examiner*—David D. Knepper
(74) *Attorney, Agent, or Firm*—Black Lowe & Graham PLLC

(57) ABSTRACT

A system, method and computer program product for performing speech detection. The method first receives a sound signal and determines if the energy value of the sound signal is above a threshold energy value. If the energy level of the signal is above the threshold energy value, the method determines a predictive signal of the received signal, subtracts the predictive signal from the signal, and determines if the result of the subtraction indicates the presence of speech. If it is determined that no presence of speech is indicated, the threshold energy value is set to the energy level of the present received signal. If it is determined that the result of the subtraction indicates the presence of speech, the received signal is sent to a speech recognition engine. The speech recognition engine generates control system commands for controlling one or more system components. The system components are vehicle system components.

29 Claims, 3 Drawing Sheets

SPEECH DETECTION SYSTEM AND METHOD

PRIORITY CLAIM

This application claims priority from U.S. Provisional Application Serial No. 60/315,805 filed Aug. 28, 2001.

FIELD OF THE INVENTION

This invention relates generally to user interfaces and, more specifically, to speech detection.

BACKGROUND OF THE INVENTION

In speech detection systems, energy contour of an inputted signal is a major factor when detecting the beginning and ending of speech sequences. This is because the level of the input speech data is often greater than the level of the background noise. An energy contour-based speech detection algorithm (SDA) contains noise evaluation, beginning of speech detection, and end of speech detection.

At the initial second that the system starts, it is assumed that the input signal to a SDA consists only of noise. At this point, the input signal is made equal to the input noise level. If the energy of the current signal rises above the energy of the input noise level, speech is assumed to be included in the current signal. If the energy of the current signal drops a threshold amount below the initial noise level, speech is assumed to not be occurring in the current signal.

The above process works well when the noise stays at a consistent level (i.e., white noise). However, there exist many environments where the noise is not so obliging. For example, if the environment is a vehicle, extraneous noises such as car horns, sirens, passing truck noise, etc. can be included in the input signal to be evaluated by a Speech Recognition Engine (SRE). Absent an appropriate mechanism to adjust for the extraneous noises, the SRE will process the noise as if it were speech, resulting in suboptimal speech recognition. Therefore, there exists a need for better speech detection in a noisy environment.

SUMMARY OF THE INVENTION

The present invention comprises a system, method and computer program product for performing speech detection. The method first receives a sound signal and determines if the energy value of the received sound signal is above a threshold energy value. If the energy level of the received signal is above the threshold energy value, the method determines a predictive signal of the received signal, subtracts the predictive signal from the received signal, and determines if the result of the subtraction indicates the presence of speech. If it is determined that no speech is present, the threshold energy value is set to the energy level of the present received signal. If it is determined that the result of the subtraction indicates the presence of speech, the received signal is sent to a speech recognition engine.

In accordance with further aspects of the invention, the speech recognition engine generates control system commands for controlling one or more system components. The system components are vehicle system components.

As will be readily appreciated from the foregoing summary, the invention provides an improved method for performing preprocessing of sound signals for more efficient use in subsequent speech processing.

BRIEF DESCRIPTION OF THE DRAWINGS

The preferred and alternative embodiments of the present invention are described in detail below with reference to the following drawings.

DETAILED DESCRIPTION OF THE PREFERRED EMBODIMENT

Figure 1:
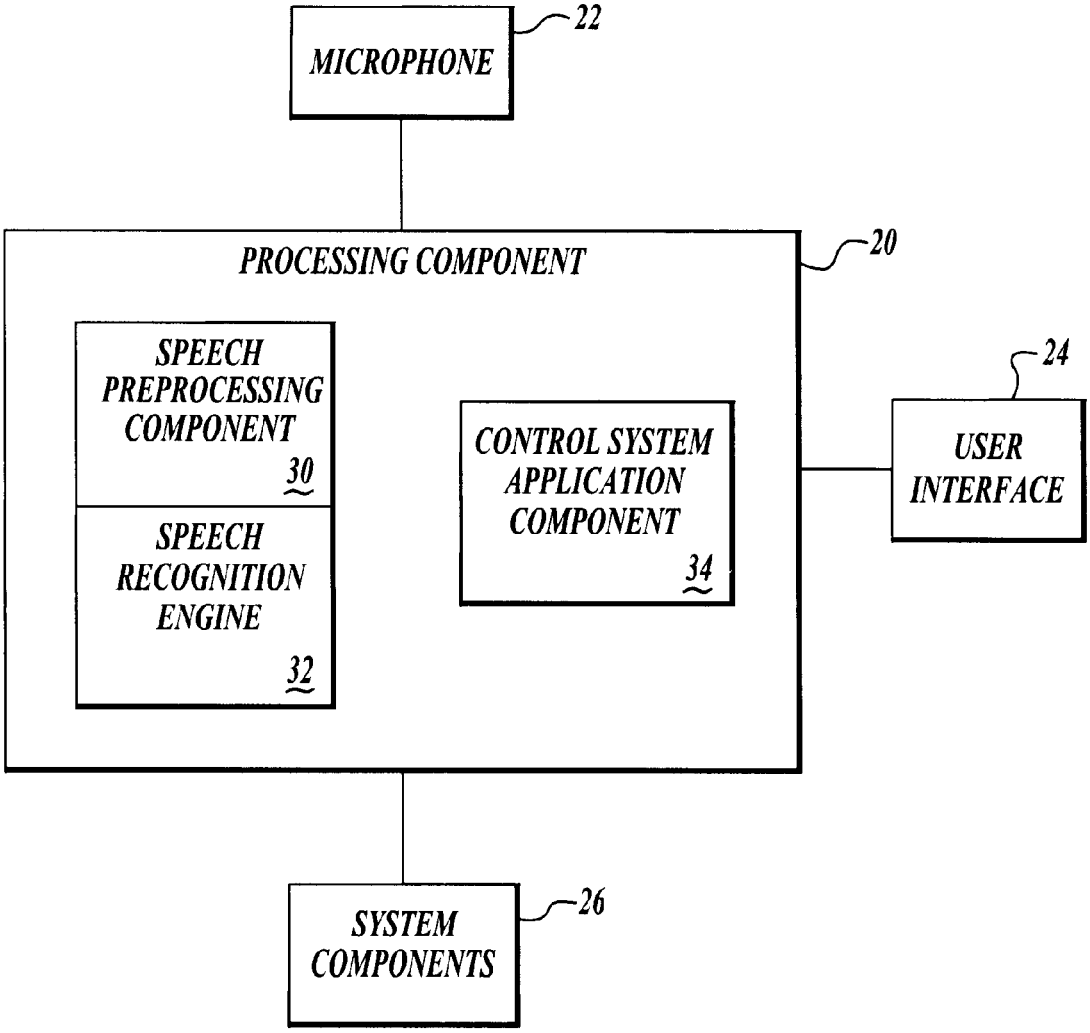
FIG. 1 is a block diagram of an example system formed in accordance with the present invention.

The present invention provides a system, method, and computer program product for performing speech detection. The system includes a processing component 20 electrically coupled to a microphone 22, a user interface 24, and various system components 26. If the system shown in FIG. 1 is implemented in a vehicle, examples of some of the system components 26 include an automatic door locking system, an automatic window system, a radio, a cruise control system, and other various electrical or computer items that can be controlled by electrical commands. Processing component 20 includes a speech preprocessing component 30, a speech recognition engine 32, a control system application component 34, and memory (not shown).

Speech preprocessing component 30 performs a preliminary analysis of whether speech is included in a signal received from microphone 22. If speech preprocessing component 30 determines that the signal received from microphone 22 includes speech, then the signal is forwarded to speech recognition engine 32. The process performed by the speech preprocessing component 30 is illustrated and described below in FIG. 2. When speech recognition engine 32 receives the signal from speech preprocessing component 30, the speech recognition engine analyzes the received signal based on a speech recognition algorithm. This analysis results in signals that are interpreted by control system application component 34 as instructions used to control functions at a number of system components 26 that are coupled to processing component 20. The type of algorithm used in speech recognition engine 32 is not the primary focus of the present invention, and could consist of any of a number of algorithms known to the relevant technical community. The method by which speech preprocessing component 30 filters noise out of a received signal or performs speech detection on a received signal from microphone 22 is described below in greater detail.

Figure 2:
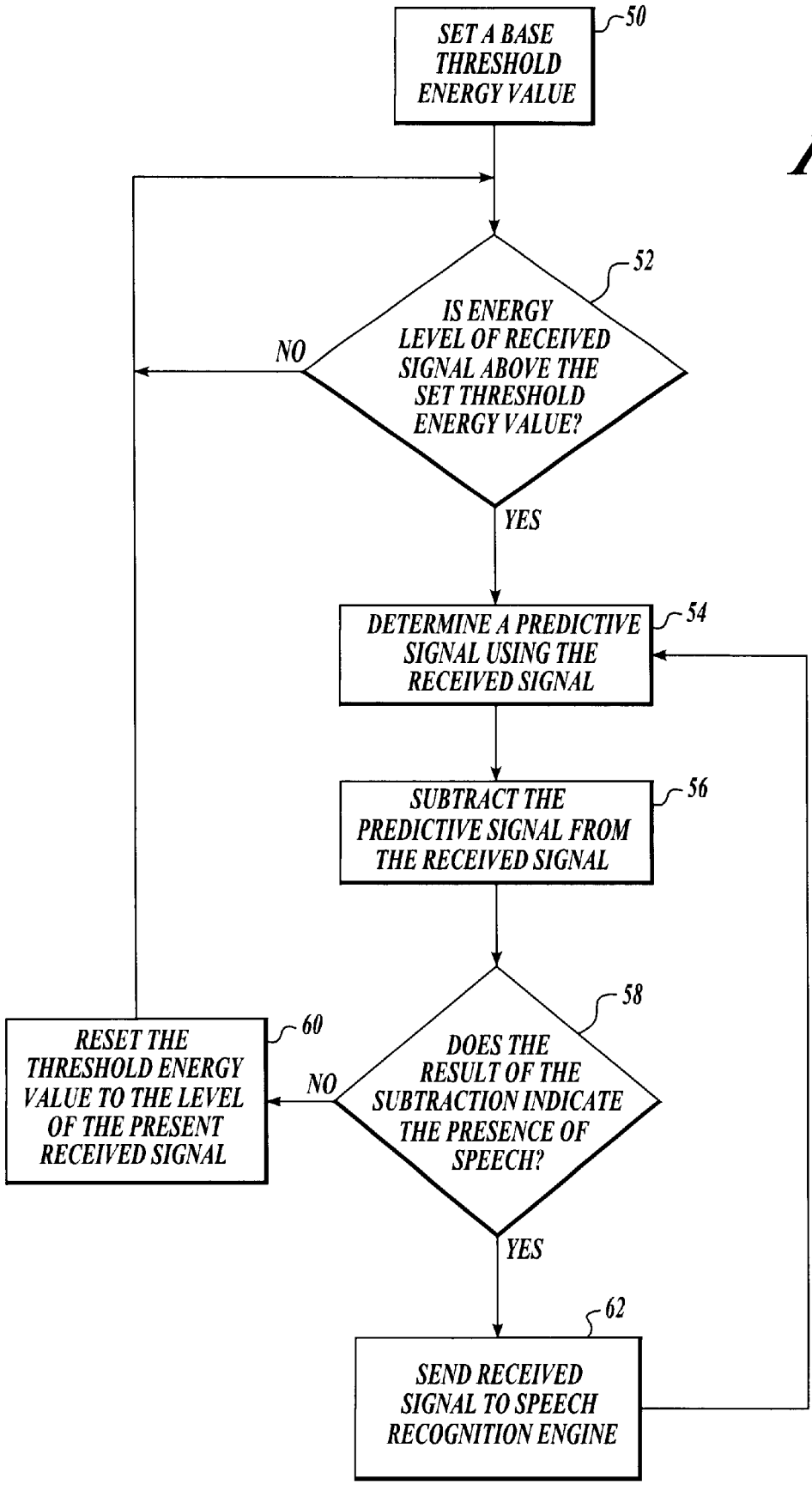
FIG. 2 is a flow diagram of a preferred process of the present invention.

FIG. 2 illustrates a preferred process performed by the present invention. At block 50, a base threshold energy value is set. This value can be set in various ways. For example, at the time the process begins and before speech is inputted, the threshold energy value is set to an average energy value of the received signal. The initial base threshold value can be preset based on a predetermined value, or it can be manually set.

At decision block 52, the process determines if the energy level of received signal is above the set threshold energy value. If the energy level is not above the threshold energy value, then the received signal is noise and the process returns to the determination at decision block 52. If the received signal energy value is above the set threshold energy value, then the received signal may include noise. At block 54, the process determines a predictive signal of the received signal. The predictive signal is preferably generated using a linear predictive coding (LPC) algorithm. An LPC algorithm provides a process for calculating a new signal based on samples from an input signal. An example LPC algorithm will be shown and described in more detail below.

At block 56, the predictive signal is subtracted from the received signal. Then, at decision block 58, the process determines if the result of the subtraction indicates the presence of speech. The result of the subtraction generates a residual error signal. In order to determine if the residual error signal shows that speech is present in the received signal, the process determines if the distances between the peaks of the residual error signal are within a frequency range. If speech is present in the received signal, the distance between the peaks of the residual error signal indicates the vibration time of ones vocal cords. An example frequency range (vocal cord vibration time) for analyzing the peaks is 60 Hz–500 Hz. An autocorrelation function is used to determine the distance between consecutive peaks in the error signal. If the subtraction result fails to indicate speech, the process proceeds to block 60, where the threshold energy value is reset to the level of the present received signal, and the process returns to decision block 52. If the subtraction result indicates the presence of speech, the process proceeds to block 62, where the received signal is sent to a speech recognition engine. Because noise is experienced dynamically, the process returns to the block 54 after a sample period of time has passed.

The following is an example LPC algorithm used during the step at block 54 to generate a predictive signal $\overline{x(n)}$. Defining $\overline{x(n)}$ as an estimated value of the received signal x(n−k) at time n, $\overline{x(n)}$ can be expressed as:

$$\overline{x(n)} = \sum_{k=1}^{K} a(k) * x(n-k)$$

The coefficients a(k), k=1, . . . , K, are prediction coefficients. The difference between x(n) and $\overline{x(n)}$ is the residual error, e(n). The goal is to choose the coefficients a(k) such that e(n) is minimal in a least squares sense. The best coefficients, a(k), are obtained by solving the following K linear equations:

$$\sum_{k=1}^{K} a(k) * R(i-k) = R(i), \quad \text{for } i = 1, \ldots, K$$

where R(i), is an autocorrelation function:

$$R(i) = \sum_{n=i}^{N} x(n) * x(n-i), \quad \text{for } i = 1, \ldots, K$$

These sets of linear equations are preferably solved using the Levinson-Durbin recursive procedure technique.

Figure 3:
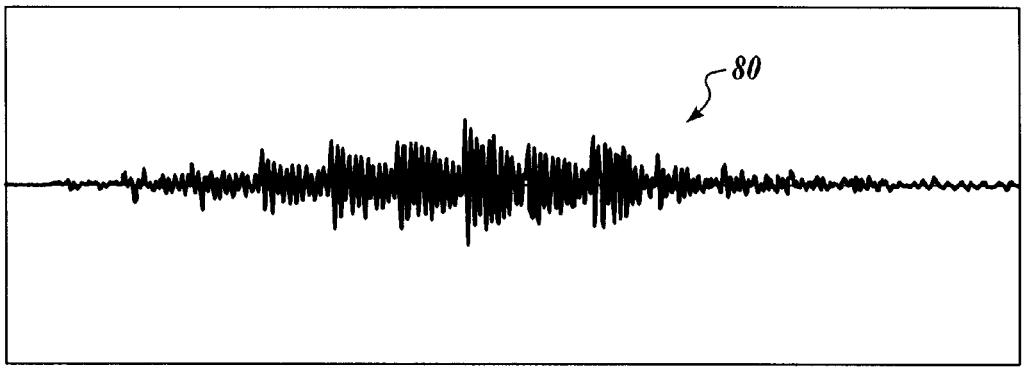
FIG. 3 is a speech input signal.
Figure 4:
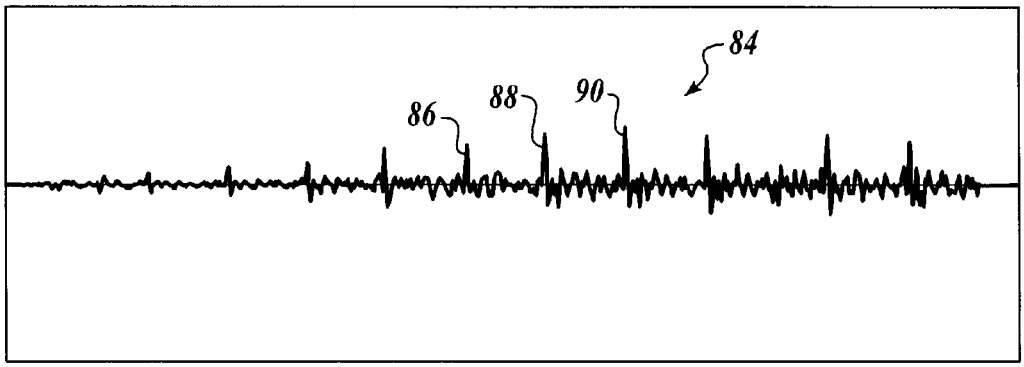
FIG. 4 is a residual error signal of the input signal shown in FIG. 3.
Figure 5:
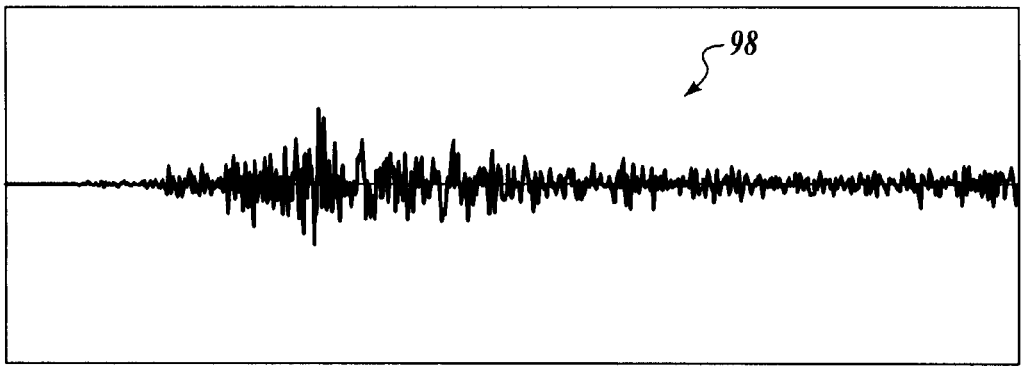
FIG. 5 is a residual error signal of a noise input signal.

FIGS. 3–5 illustrate example signals processed in and produced by the present invention. FIG. 3 illustrates the time domain representation of the word "base." The signal for base 80 is sent through the processing steps of blocks 54 and 56 of FIG. 2. The result of block 56 for signal 80 is an error signal 84 as shown in FIG. 4. Resulting error signal 84 is processed to determine if it exhibits speech characteristics. In this example, the process determines that signal 84 exhibits speech characteristics because the distance between the peaks 86–90 fall within a preferred frequency range, such as 60 Hz–500 Hz.

FIG. 5 illustrates an error signal 98 that is the output of block 56 for a signal that does not include any speech. The error signal 98 does not exhibit the same properties between the peaks as that of signal 84, thereby indicating that speech is not present.

While the preferred embodiment of the invention has been illustrated and described, as noted above, many changes can be made without departing from the spirit and scope of the invention. Accordingly, the scope of the invention is not limited by the disclosure of the preferred embodiment.

The embodiments of the invention in which an exclusive property or privilege is claimed are defined as follows:

1. A method for performing speech detection, the method comprising:

receiving a sound signal;

determining if the energy value of the received sound signal is above a threshold energy value; and if the energy level of the received signal is above the threshold energy value, determining a predictive signal of the received signal using a prediction algorithm, subtracting the predictive signal from the received signal, and determining if the result of the subtraction indicates the presence of speech, if it is determined that no presence of speech is indicated, modifying the threshold energy value based on the energy level of the present received signal; and if it is determined that the presence of speech is indicated, sending the received signal to a speech recognition engine.

2. The method of claim 1, wherein determining if the energy level of the received signal is above the threshold energy value comprises determining if one or more distances between peaks of the result of the subtraction are within a threshold frequency range.

3. The method of claim 1, wherein sending the received signal to a speech recognition engine further comprises generating a control system command for controlling one or more system components.

4. The method of claim 3, wherein the system components are vehicle system components.

5. The method of claim 1, wherein the prediction algorithm is a linear prediction coding (LPC) algorithm.

6. The method of claim 5, wherein the LPC algorithm is expressed as:

$$\overline{x(n)} = \sum_{k=1}^{K} a(k) * x(n-k),$$

wherein coefficients a(k), k=1, . . . , K, are prediction coefficients.

7. A computer program product for performing speech detection, the product performing the method comprising:

receiving a sound signal;

determining if the energy value of the received sound signal is above a threshold energy value; and if the energy level of the received signal is above the threshold energy value, determining a predictive signal of the received signal using a prediction algorithm, subtracting the predictive signal from the received signal, and determining if the result of the subtraction indicates the presence of speech, if it is determined that no presence of speech is indicated, modifying the threshold energy value based on the energy level of the present received signal; and if it is determined that the presence of speech is indicated, sending the received signal to a speech recognition engine.

8. The product of claim 7, wherein determining if the energy level of the received signal is above the threshold energy value comprises determining if one or more distances between peaks of the result of the subtraction are within a threshold frequency range.

9. The product of claim 7, wherein sending the received signal to a speech recognition engine further comprises generating a control system command for controlling one or more system components.

10. The product of claim 9, wherein the system components are vehicle system components.

11. The computer program product of claim 7, wherein the prediction algorithm is a linear prediction coding (LPC) algorithm.

12. The computer program product of claim 11, wherein the LPC algorithm is expressed as:

$$\overline{x(n)} = \sum_{k=1}^{K} a(k) * x(n-k),$$

wherein coefficients a(k), k=1, . . . , K, are prediction coefficients.

13. A method for performing speech detection, the method comprising:

(i) receiving a sound signal;

(ii) determining if the energy value of the received sound signal is above a threshold energy value;

(iii) if the energy level of the received signal is above the threshold energy value, determining a predictive signal of the received signal using a prediction algorithm, subtracting the predictive signal from the received signal, and determining if the result of the subtraction indicates the presence of speech, if it is determined that no presence of speech is indicated, modifying the threshold energy value based on the energy level of the present received signal and returning to ii; and if it is determined that the presence of speech is indicated, sending the received signal to a speech recognition engine and returning to iii; and (iv) if the energy level of the received signal is not above the threshold energy value, return to ii.

14. The method of claim 13, wherein determining of iii comprises determining if one or more distances between peaks of the result of the subtraction are within a threshold frequency range.

15. The method of claim 13, wherein sending the received signal to a speech recognition engine further comprises generating a control system command for controlling one or more system components.

16. The method of claim 15, wherein the system components are vehicle system components.

17. The method of claim 13, wherein the prediction algorithm is a linear prediction coding (LPC) algorithm.

18. The method of claim 17, wherein the LPC algorithm is expressed as:

$$\overline{x(n)} = \sum_{k=1}^{K} a(k) * x(n-k),$$

wherein coefficients a(k), k=1, . . . , K, are prediction coefficients.

19. A computer program product for performing speech detection, the product performing the method comprising:

(i) receiving a sound signal;

(ii) determining if the energy value of the received sound signal is above a threshold energy value;

(iii) if the energy level of the received signal is above the threshold energy value, determining a predictive signal of the received signal using a prediction algorithm, subtracting the predictive signal from the received signal, and determining if the result of the subtraction indicates the presence of speech, if it is determined that no presence of speech is indicated, modifying the threshold energy value based on the energy level of the present received signal and returning to ii; and if it is determined that the presence of speech is indicated, sending the received signal to a speech recognition engine and returning to iii; and (iv) if the energy level of the received signal is not above the threshold energy value, return to 11.

20. The product of claim 19, wherein determining of iii comprises determining if one or more distances between peaks of the result of the subtraction are within a threshold frequency range.

21. The product of claim 19, wherein sending the received signal to a speech recognition engine further comprises generating a control system command for controlling one or more system components.

22. The product of claim 21, wherein the system components are vehicle system components.

23. The computer program product of claim 19, wherein the prediction algorithm is a linear prediction coding (LPC) algorithm.

24. The computer program product of claim 23, wherein the LPC algorithm is expressed as:

$$\overline{x(n)} = \sum_{k=1}^{K} a(k) * x(n-k),$$

wherein coefficients a(k), k=1, . . . , K, are prediction coefficients.

25. A speech detection system comprising:

a first component configured to receive a sound signal;

a second component configured to determine if the energy value of the received sound signal is above a threshold energy value;

a third component configured to generate a predictive signal of the received signal using a prediction algorithm, subtract the predictive signal from the received signal, and determine if the result of the subtraction indicates the presence of speech, if the energy level of the received signal is above the threshold energy value;

a fourth component configured to modify the threshold energy value based on the energy level of the present received signal and return to the second component, if it is determined that no presence of speech is indicated;

a fifth component configured to send the received signal to a speech recognition engine and return to the third component, if it is determined that the presence of speech is indicated; and a sixth component configured to return to the second component, if the energy level of the received signal is not above the threshold energy value.

26. The system of claim 25, wherein the fifth component is further configured to generate a control system command for controlling one or more system components.

27. The system of claim 26, wherein the system components are vehicle system components.

28. The speech detection system of claim 25, wherein the prediction algorithm is a linear prediction coding (LPC) algorithm.

29. The speech detection system of claim 28, wherein the LPC algorithm is expressed as:

$$\overline{x(n)} = \sum_{k=1}^{K} a(k) * x(n-k),$$

wherein coefficients a(k), k=1, . . . , K, are prediction coefficients.

* * * * *